US009033212B2

(12) United States Patent
Fuchs

(10) Patent No.: US 9,033,212 B2
(45) Date of Patent: May 19, 2015

(54) RECTANGULAR STAND UP THIN FILM CONTAINER

(75) Inventor: Albrecht Fuchs, Zikhron Yaaqov (IL)

(73) Assignee: BETH-EL ZIKHRON YA'AKOV INDUSTRIES LTD., Zikhron Yaaqov (IL)

( * ) Notice: Subject to any disclaimer, the term of this patent is extended or adjusted under 35 U.S.C. 154(b) by 297 days.

(21) Appl. No.: 13/695,100

(22) PCT Filed: May 4, 2011

(86) PCT No.: PCT/IL2011/000357

§ 371 (c)(1),
(2), (4) Date: Oct. 29, 2012

(87) PCT Pub. No.: WO2011/138781

PCT Pub. Date: Nov. 10, 2011

(65) Prior Publication Data

US 2013/0048703 A1 Feb. 28, 2013

(30) Foreign Application Priority Data

May 4, 2010 (IL) ..... 205527

(51) Int. Cl.
*B65D 30/16* (2006.01)
*B65D 6/00* (2006.01)
(Continued)

(52) U.S. Cl.
CPC ..... *B65D 31/06* (2013.01); *A47G 23/0258* (2013.01); *B65D 5/4279* (2013.01);
(Continued)

(58) Field of Classification Search
USPC ..... 229/117.19, 117.23, 122.23, 125.14, 229/125.15, 163, 198.2, 941; 220/741, 752, 220/756, 758, 759, 768; 294/27.1, 31.2; 222/210, 465.1, 469, 475
See application file for complete search history.

(56) References Cited

U.S. PATENT DOCUMENTS 2,029,051 A 1/1936 Blevins
2,635,000 A * 4/1953 Baker ..... 294/27.1
(Continued)

FOREIGN PATENT DOCUMENTS

FR 2267248 11/1975
WO 2005/051773 6/2005

OTHER PUBLICATIONS

Yoursportsmemorabilia.com http://www.yoursportsmemorabilia.com/shop/index.php?main_page=product_info&products_id=598; (1 page) Sep. 2, 2009.
(Continued)

*Primary Examiner* — Gary Elkins
(74) *Attorney, Agent, or Firm* — Roach Brown McCarthy & Gruber, P.C.; Kevin D. McCarthy

(57) ABSTRACT

A thin film rectangular cuboid stand-up container composed of a first and a second elongated rectangular sheets of a thin film weldable plastic or laminate material, wherein the length of each of the first and second sheets is approximately equal to twice the length of a selected edge of the container plus the width of the other sheet, the first sheet is folded along two transversal lines to form first three panels of the rectangular cuboid container and the second sheet is folded along two transversal lines to form the complementary three panels of the rectangular cuboid container, the first and second sheets are seamed to each other along a welding margin surrounding their entire periphery forming an endless loop of fin like seam band extending along 8 of the 12 cuboid edges.

19 Claims, 13 Drawing Sheets

(51) Int. Cl.

| | |
|---|---|
| ***B65D 25/28*** | (2006.01) |
| ***B65D 25/48*** | (2006.01) |
| *A47G 23/02* | (2006.01) |
| *B65D 5/42* | (2006.01) |
| *B65D 5/74* | (2006.01) |
| *B65D 5/40* | (2006.01) |
| *B65D 5/32* | (2006.01) |

(52) U.S. Cl.

CPC ..... *B65D 5/746* (2013.01); *B65D 5/40* (2013.01); *B65D 5/324* (2013.01); *B65D 11/105* (2013.01); *B65D 25/2817* (2013.01); *B65D 25/48* (2013.01)

(56) References Cited

U.S. PATENT DOCUMENTS

| | | | | | |
|---|---|---|---|---|---|
| 2,731,167 | A | | 1/1956 | Moore | |
| 3,056,622 | A | | 10/1962 | Hilderbrandt | |
| 3,184,140 | A | * | 5/1965 | Peterson | 229/122.23 |
| 3,357,631 | A | * | 12/1967 | Aid et al. | 229/163 |
| 3,380,646 | A | | 4/1968 | Doyen | |
| 3,622,063 | A | * | 11/1971 | McVeigh | 229/122.23 |
| 3,698,624 | A | * | 10/1972 | Stark | 229/122.21 |
| 4,050,623 | A | * | 9/1977 | Vacchi | 229/122.21 |
| 4,468,212 | A | * | 8/1984 | Jennings | 493/52 |
| 4,669,627 | A | * | 6/1987 | Ueda et al. | 220/741 |
| 4,919,269 | A | | 4/1990 | Wright | |
| 4,971,243 | A | | 11/1990 | Lisiecki | |
| 5,203,470 | A | | 4/1993 | Brown | |
| 5,272,855 | A | | 12/1993 | Togi | |
| 5,842,790 | A | | 12/1998 | Imer | |
| 6,464,096 | B2 | * | 10/2002 | Adams et al. | 229/125.15 |
| 6,543,825 | B1 | * | 4/2003 | Dragutin | 294/31.2 |
| 6,979,031 | B2 | * | 12/2005 | Coppotelli et al. | 294/27.1 |
| 8,321,024 | B2 | * | 11/2012 | Georgakopoulos et al. | 607/44 |
| 2005/0031230 | A1 | | 2/2005 | Emst | |
| 2009/0217677 | A1 | * | 9/2009 | Shin et al. | 220/752 |

OTHER PUBLICATIONS

ISR of PCT/IL/11/00357 (3 pages) mailed Nov. 15, 2011.

* cited by examiner

RECTANGULAR STAND UP THIN FILM CONTAINER

REFERENCE TO CO-PENDING APPLICATIONS

Priority is claimed as a 371 of international application number PCT/IL2011/000357, filed on May 4, 2011; which claims priority to Isreali Patent application serial number 205527, filed on May 4, 2010.

FIELD OF THE INVENTION

The present invention relates to a flexible thin film container, more particularly to a stand-up, rectangular thin film container intended for pour-able content and a method of producing the same.

BACKGROUND OF THE INVENTION

The stand-up thin film plastic or laminate pouch was first introduced in 1963 by Leon and Louis Doyen as disclosed in U.S. Pat. No. 3,380,646. The basic pouch design consists of a single folded sheet of which the median longitudinal portion is folded in so as to form a "W" section. The folded sheet is heat seamed along its sides joining together the four panels of the "W" section. Additional oblique welds (gusset) unite each of the outer panels to the opposing panel of the inwardly folded portion. When the pouch is filled, the inwardly folded, gusseted bottom expands and provide a substantially hexagonal base on which the pouch can stand. In the basic design the top edge is sealed after a content is poured in, however later modifications include large variety of enclosures.

The benefit of such pouches over existing bottles or cardboard containers relates to the fact that the pouches are easily folded after emptied producing very little volume of waste when discarded. Additionally flexible pouches are assembled at site out of rolled raw material using relatively inexpensive form-fill-seal machines, therefore transportation of empty containers is eliminated.

When filled with any kind of pour-able content, the stand-up pouch accepts a stable structure which tapers from the hexagonal bottom to a flat lined top. However, when the content is partly consumed it becomes unstable due to the weight of the enclosure and tends to tip over. Additionally, if a classic upward orientation of the enclosure is desired, it requires the use of a "canoe" style adapter seamed between the opposing panels. The "canoe" shape smooths the transition of the weld between the abutting panels and the adapter. Yet, sealing efficiency of the "canoe" adapter is not as consistent as provided with a sidewards facing flanged spout which is typically heat welded to one of the panels at an early stage of the production process as taught for example in U.S. publication No. 2005/0031230.

A recent dual-end gusseted stand-up pouch also known as the "S-Pouch", introduce an additional gusseted top face similar in shape to the bottom one, providing a flat upper surface readily accepting a flanged spout. The dual end gusseted pouch accepts a substantially cylindrical shape when filled up and is somewhat more stable than the original design when partly emptied.

Cylindrical containers however, prevent optimal use of the freight volume during transportation. As much as 25% of the cargo is air gap located between the individual cylindrical containers. To optimize transportation, and package material waste, rectangular cuboid packages are preferred.

Furthermore cylindrical beverage pouches have an outdated unpleasant look compared to the neat straight lined, rectangular shaped containers such as made of cardboard and provided for instance by "Tetrapack".

Additionally, flexible pouches by their nature are awkward in lifting, handling and pouring as they lack a firm envelope for gripping and tend to collapse around the gripping area when lifted, making a threaded cap removal or even simple pouring, a frustrating task.

Consequently a new approach is required to improve the material usability, space efficiency, ease of handling, pouring and general appearance of thin film containers.

SUMMARY OF THE INVENTION

It is thus one object of the present invention to provide a thin film rectangular cuboid stand-up container generating minimal waste of film material during production. It is another object of the present invention to improve handling, ease of cap removal and pouring ability to the level of standard bottles. It is yet a further object of the present invention to provide a method of producing the same.

These objects are achieved according to one aspect of the present invention by providing a flexible rectangular cuboid container composed of a first and a second elongated rectangular sheets of a thin film weldable plastic or laminate material, wherein the length of each of the first and second sheets is approximately equal to twice the length of a selected edge of the container plus the width of the other sheet, the first sheet is folded along two transversal lines to form the first three panels of the rectangular cuboid container and the second sheet is folded along two transversal lines to form the complementary three panels of the rectangular cuboid container, the first and second sheets are seamed to each other along a welding margin surrounding their entire periphery forming an endless loop of fin like seam band extending along 8 of the 12 cuboid edges.

In accordance with another aspect of the present invention there is provided a container as described above, wherein the length of each of said first and second sheets is approximately equal to twice the height of the container plus the width of the other sheet, the first sheet is folded along two transversal lines to form a base and two equal in length, parallel, opposing sidewalls and the second sheet is folded along two transversal lines to form a top face and the complementary two equal in length, parallel, opposing sidewalls.

Yet in accordance with another aspect of the present invention there is provided a container as described above, wherein a top face of the container is perforated with at least one opening prior to folding and seaming of the associated second sheet, with a hole sized to accept a spout having a planar flange, which is facially welded to the top face of the container by a peripheral seam around the at least one opening.

In accordance with an additional aspect of the present invention there is provided a container as described above, further comprising a reusable lifting device composed of a handle provided at its upper end with an elastic fork projecting at right angle to the handle and a rectangular frame slightly larger in size than the cross section of the container extending at right angle at the bottom end of the handle below said fork.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
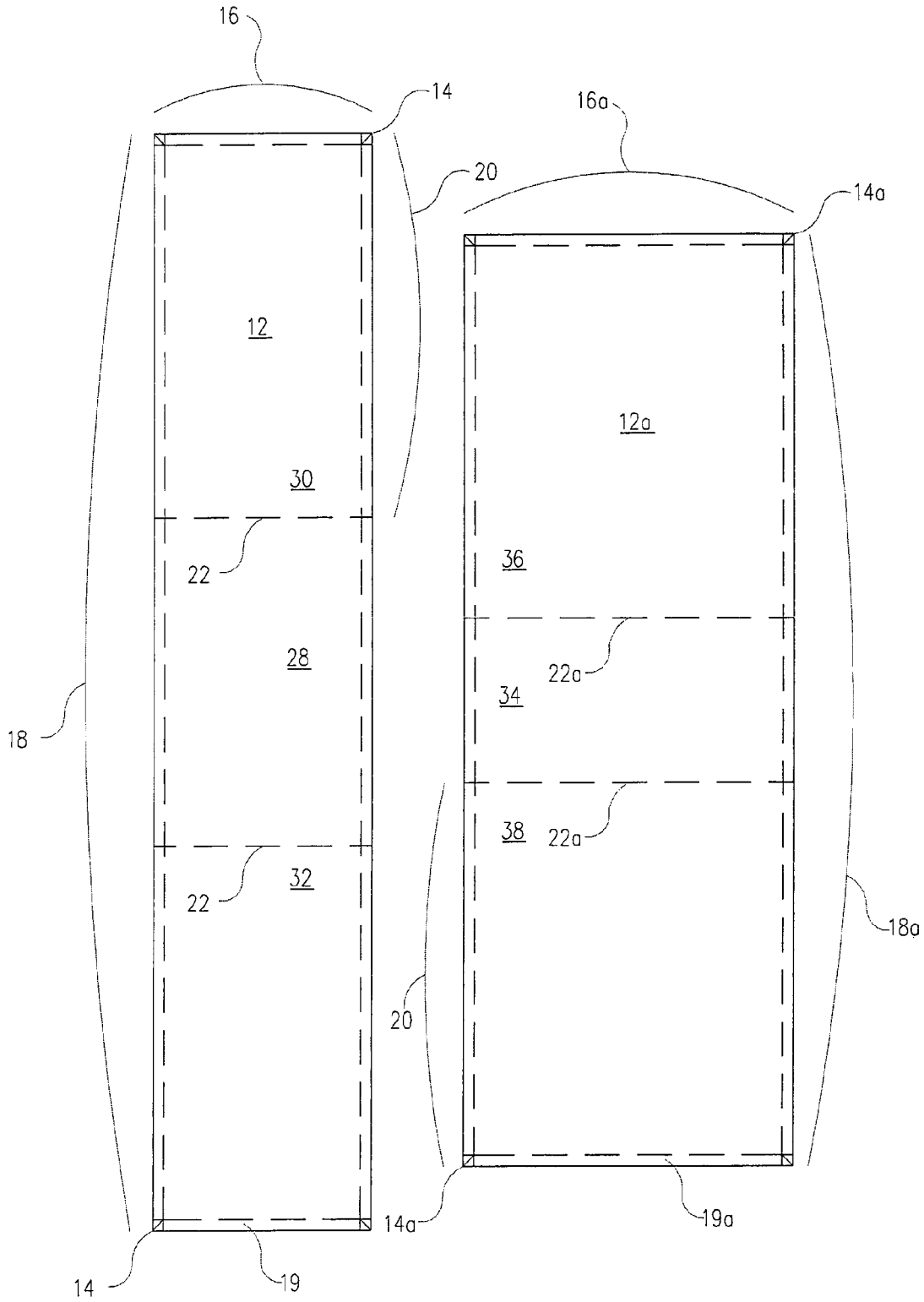
FIG. 1 is a planar view of two sheets of raw material used in production of one container according to the present invention.

In the following description, identical elements that appear in more than one figure or that share similar functionality will be indicated by identical reference numerals.

With reference to FIGS. 1 to 4, a flexible rectangular cuboid container made in accordance with an embodiment of the present invention is illustrated, generally referenced 10 (FIG. 4), composed of a first and a second elongated rectangular sheets 12, 12*a* respectively (FIG. 1), of a thin film weldable plastic or laminate material.

Figure 2:
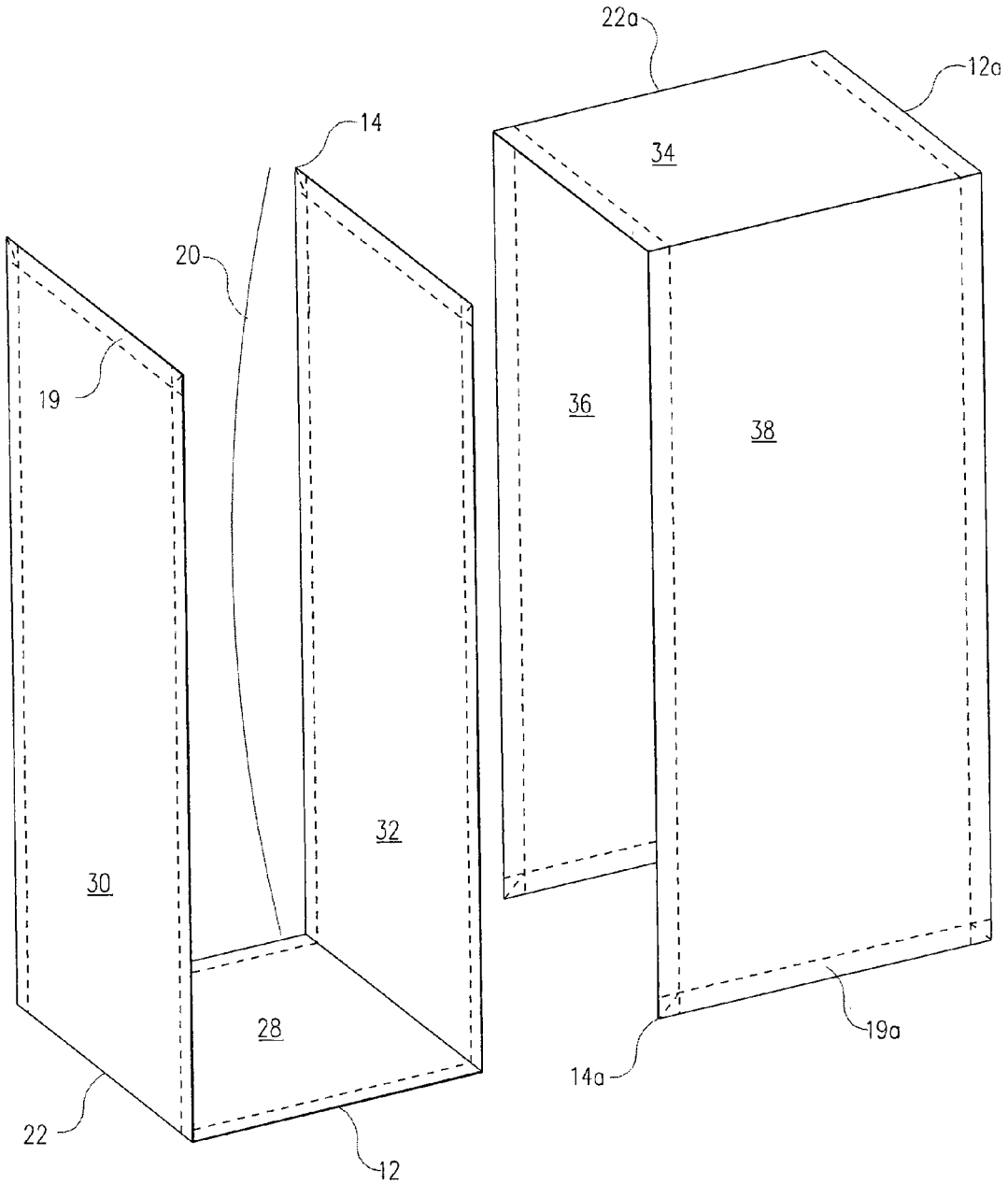
FIG. 2 is a perspective view of the sheets of FIG. 1 after a first folding step.
Figure 3:
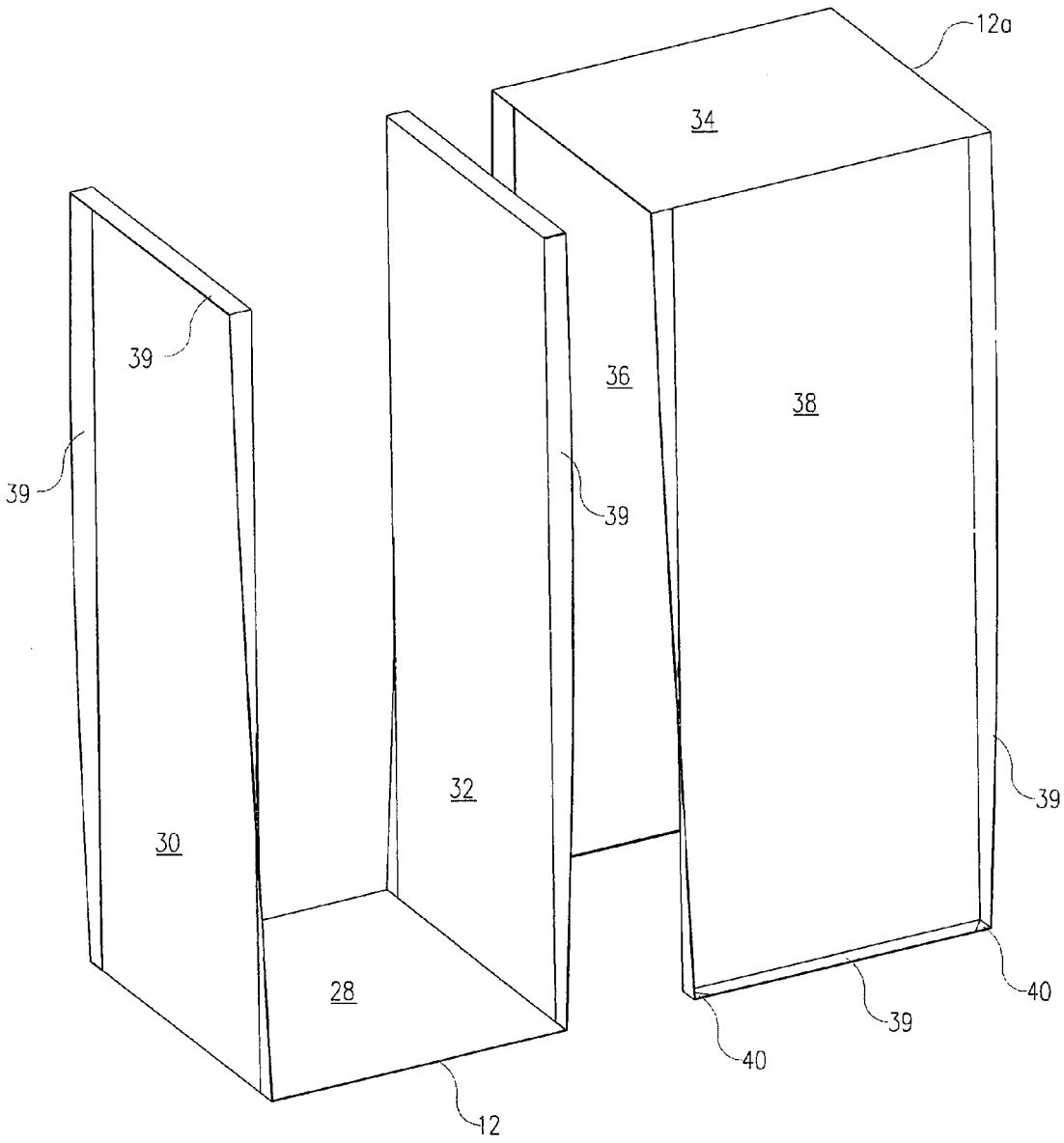
FIG. 3 is a perspective view of the sheets of FIG. 1 after a second preparation step.

The first and second sheets 12, 12*a* may differ in width 16, 16*a* or length 18, 18*a* respectively, however the length of each of the sheets is approximately equal to twice the height 20 of the container 10 plus the width 16 or 16*a* of the other sheet. As shown in FIG. 2, the first sheet 12 is folded along two transversal lines 22 to form a base 28 and two equal in length, parallel, opposing sidewalls 30, 32 of the container 10. Likewise, the second sheet 12*a* is folded along two transversal lines 22*a* to form a top face 34 and the complementary two equal in length, parallel, opposing sidewalls 36, 38 of the container 10. A welding margin 19, 19*a*, surrounding the first and second rectangular sheets 12, 12*a* respectively, indicated by a dashed line in FIG. 1, is gradually outwardly folded along the free boundaries of sidewalls 30, 32, 36, 38 of both sheets 12, 12*a*, to form a narrow welding strip 39 (FIG. 3) as a preparation step prior to seaming the sheets 12 and 12*a* to each other along the welding strip 39. The four corners 14, 14*a* of each of the sheets 12, 12*a* respectively, are folded during this preparation step as an overlapping triangular 40 (FIG. 3) to ensure quality sealing of the folded corners. It will be understood that the preparation step of folding the welding margin 19, 19*a* may be carried out before the step of folding the side walls. The two sheets 12, 12*a* are seamed to each other along the welding margins 19, 19*a* of their entire periphery forming an endless loop of fin like seam band 42 extending along 8 of the 12 cuboid edges.

While the above embodiment represent a specific construction of the container wherein the common in length sidewalls 30, 32, 36, 38 define the height of the container, it should be noted that the container may accept a broader definition in which the length of each of the sheets 18 or 18*a*, may approximately equal to twice the length of any selected edge of the container plus the width of the other sheet 16 or 16*a*. The first sheet 12 is folded along two transversal lines 22 to form first three panels 28, 30, 32 of the rectangular cuboid container and the second sheet 12*a* is folded along two transversal lines 22*a* to form the complementary three panels 34, 36, 38 of the rectangular cuboid container.

Figure 4:
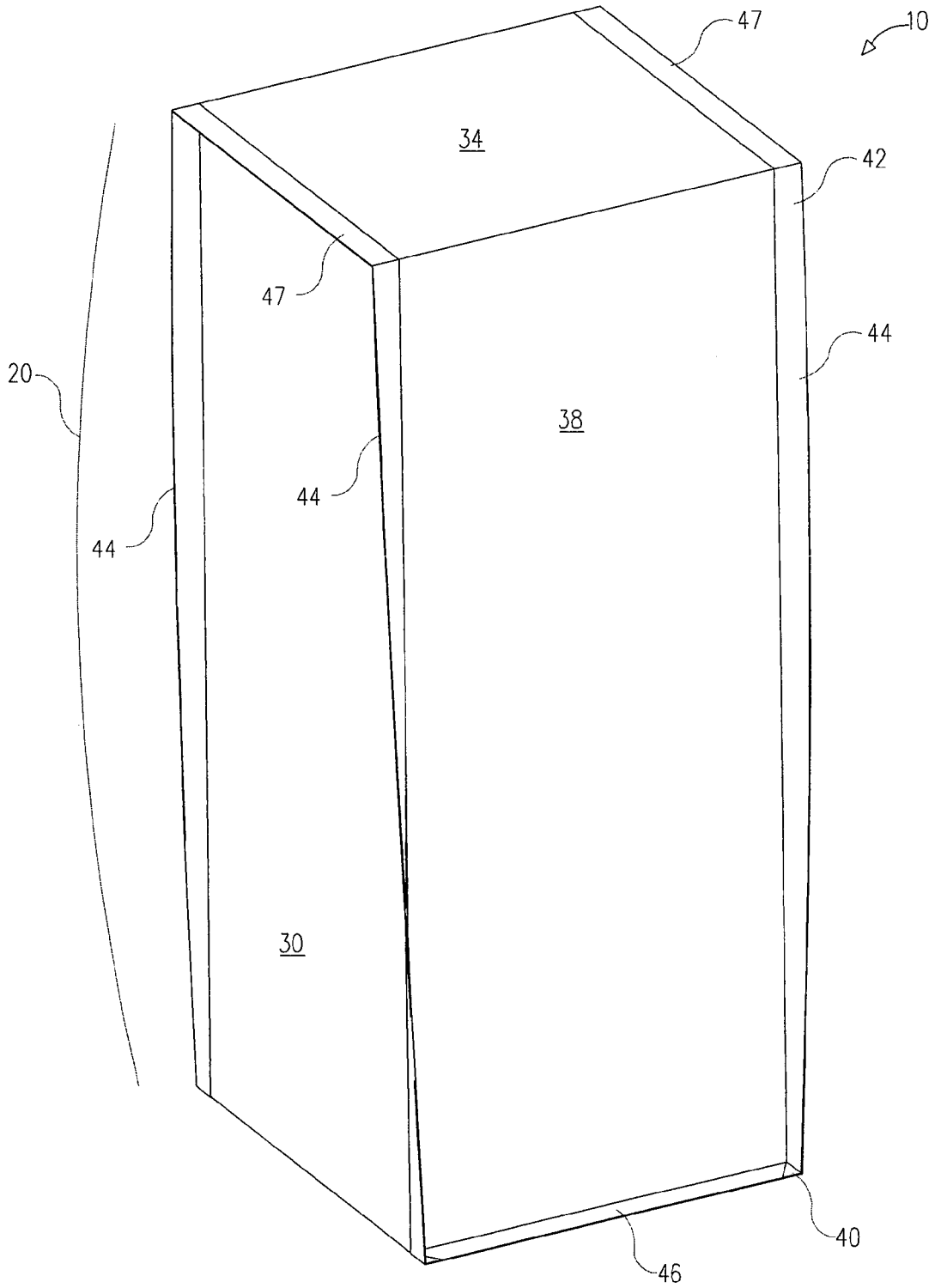
FIG. 4 is a perspective view of an assembled container made in accordance with the present invention.

As shown in FIG. 4, the vertical sections 44 of the fin like seam band 42, binding the four sidewalls 30, 32, 36, 38 accept the form of a 90° helix ranging along the height of the container. The helical contour of the vertical sections 44 flows naturally from the bottom seam bands 46 being planar with the base 28, towards the top seam bands 47 being planar with the top face 34. The helical structure eliminates stretching or sharp folding of the thin film material during production.

Figure 5:
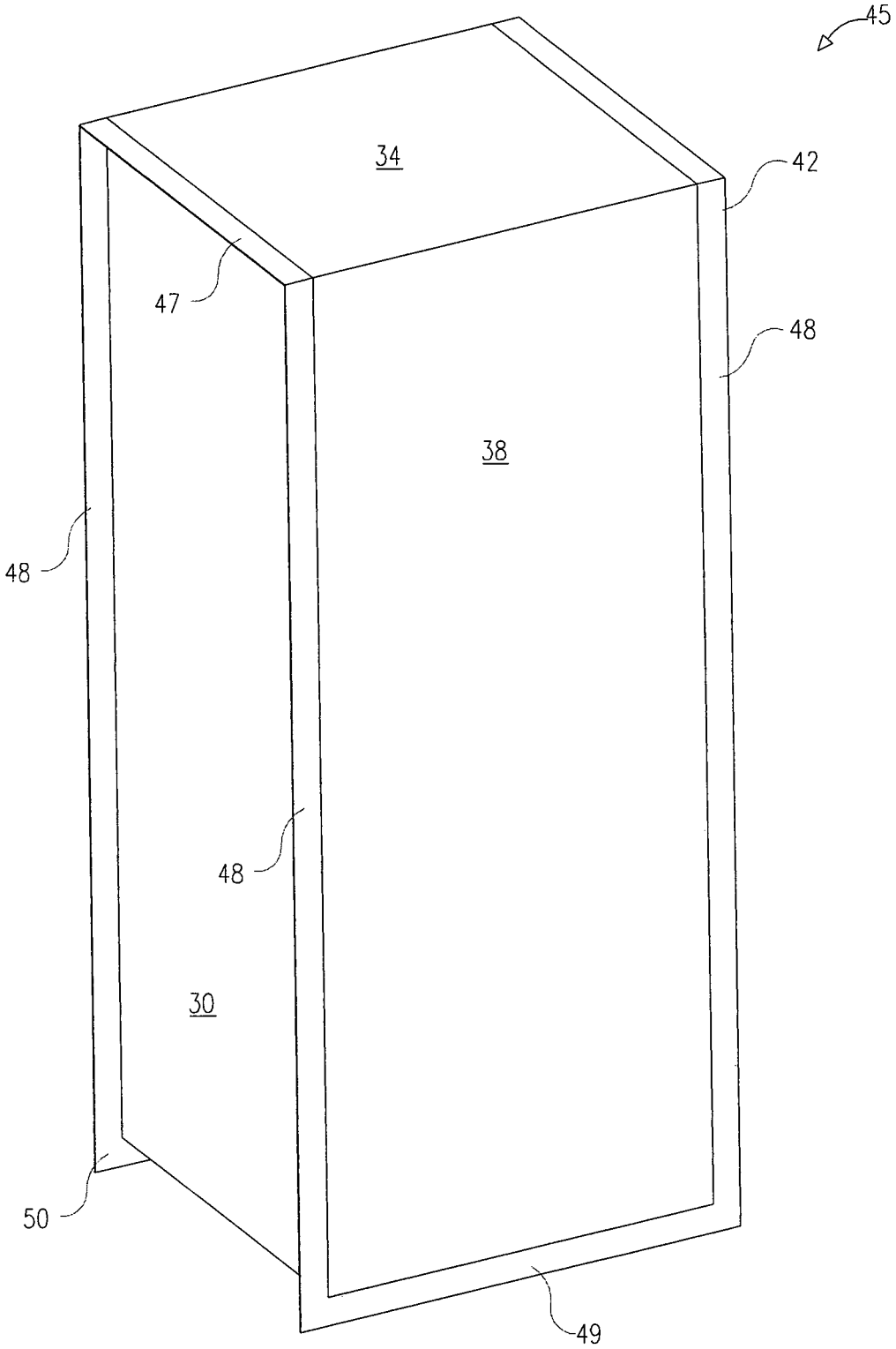
FIG. 5 is a perspective view of an assembled container made in accordance with a second embodiment of the present invention.

With reference to FIG. 5, in another embodiment of the flexible rectangular cuboid container, generally referenced 45, the vertical sections 48 of the fin like seam band 42, binding the four sidewalls 30, 32, 36, 38 accept the form of straight vertical bands being planar with the second sheet 20*a* side walls 36, 38. The straight sections 48, extend from the bottom seam bands 49 being planar with the same second sheet 20*a* side walls 36, 38, towards the top seam bands 47 being planar with the top face 34, this configuration require outwardly stretching of a seam band region 49 adjacent the base 28 corners 50 of the first sheet 12.

Figure 6:
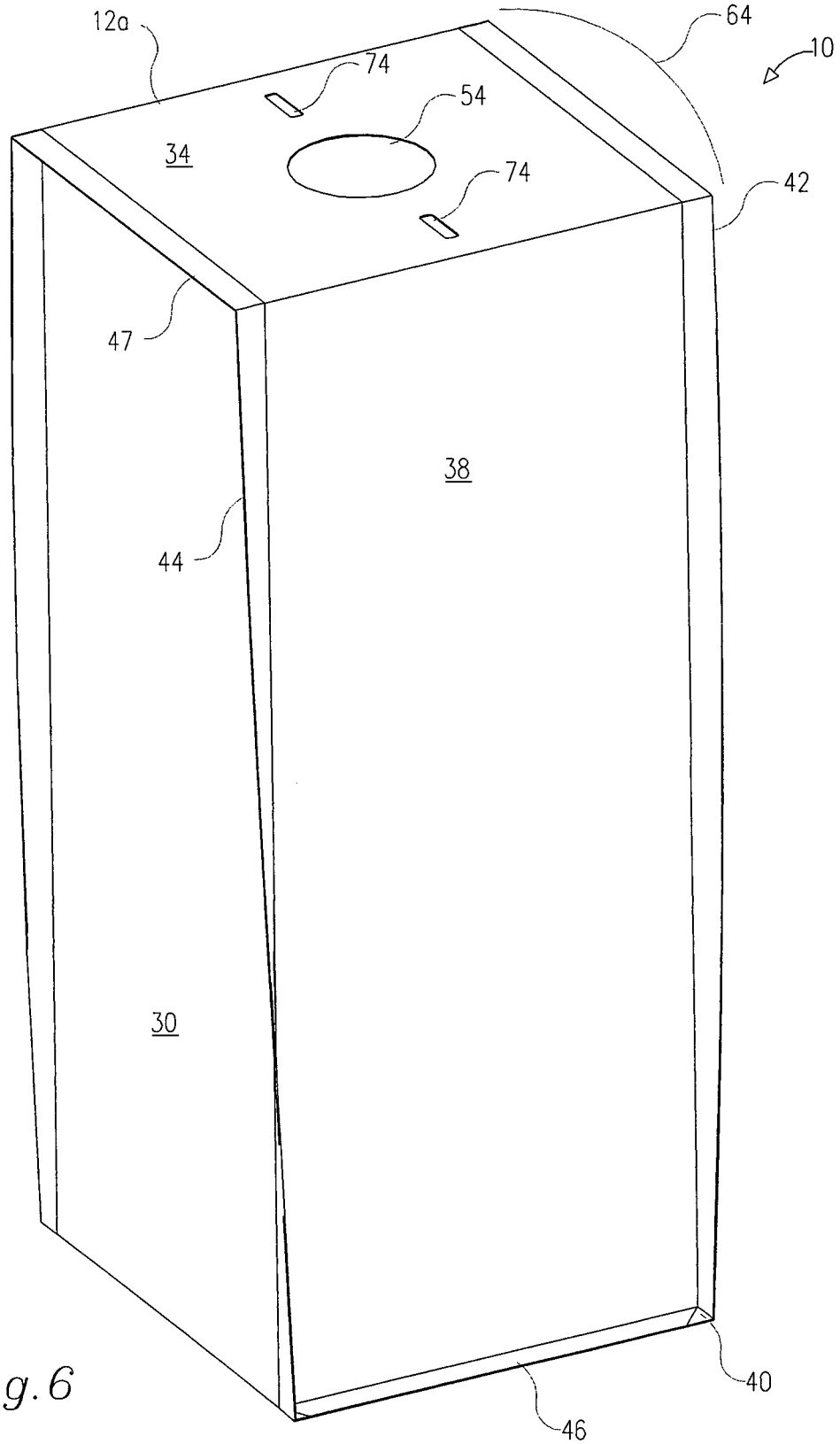
FIG. 6 is a perspective view of the container of FIG. 4, including additional preparation step.
Figure 7A:
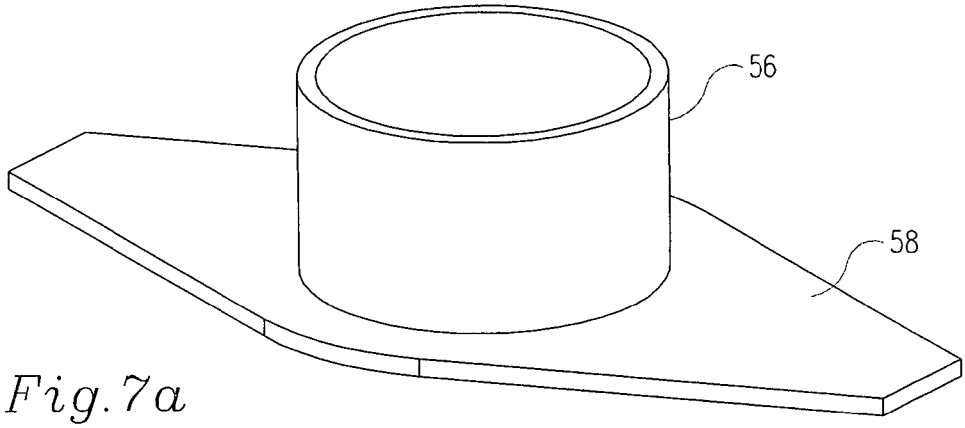
FIGS. 7*a*, 7*b*, 7*c* are perspective views of three variations of a spout made in accordance with an embodiment of the present invention.
Figure 8:
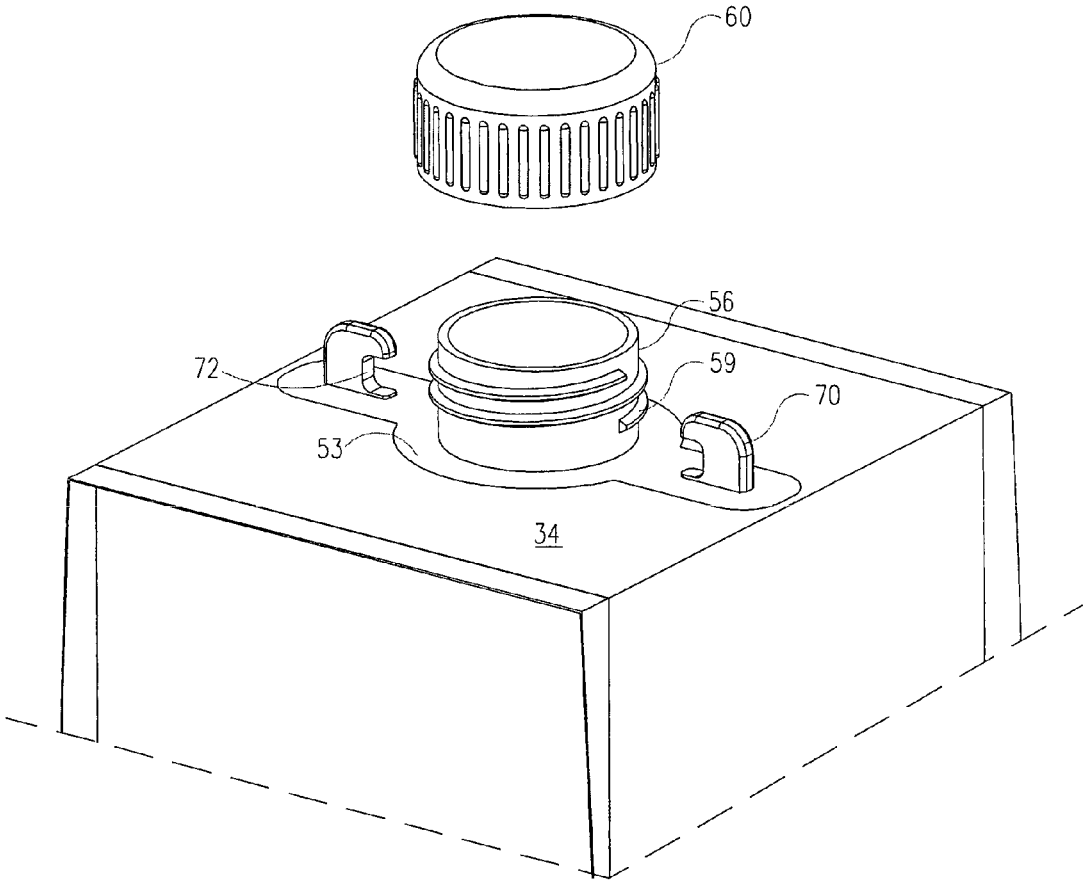
FIG. 8 is a perspective view of the top portion of the assembled container of FIG. 6, including welded spout and cap.

The complete container 10 as shown in FIG. 4, may be filled prior to final seaming with a solid or granular content typically intended for immediate consume where there is no need to reseal the container. Advantageously, in order to serve as a bottle replacement with a resealable cap or lid, the top face 34 of the container 10 is punched or otherwise perforated with at least one opening 54 (FIG. 6) prior to folding and seaming of the associated second sheet 12*a*. The opening 54 is sized to accept a spout 56 (FIG. 7*a*) with a planar flange 58, which is facially welded to the top face 34 of the container 10, by a peripheral seam 53 (FIG. 8) around at least the opening 54. The flange 58 may be welded from beneath or from above the top face 34 depending on its raw material and the order of laminate layers.

The spout 56 may include an external thread (FIG. 7*b*) to accommodate an internally threaded cap 60 (FIG. 8), as known in the art. Optionally or additionally the spout may be sealed with a heat welded thin film lead normally having a pulling tab for opening. Other sealing methods may include elastic snap-on caps, plastic tear-off lids or any combinations of the above.

Slackening of a threaded cap typically equipped with a temper proof tear lip requires a considerable amount of torque, which by nature is difficult to apply on flexible containers. In order to facilitate the removal of a threaded cap 60, the spout flange 58 (FIG. 7*a*), may receive an elongated shape preferably with its longer axis 62 sized to fit the width 64 of the container 10. The distal flange edges 66 provide rigid substance for gripping of the container while slackening the cap 60. It will be understood that the rigid edges 66 are usable as gripping points even if the spout flange 58 is welded from beneath the top face 34 of the container 10.

In another embodiment of the present invention, the flange 58 (FIG. 7*c*) is provided with upwardly protruding lifting extensions 70 adjacent both edges 66 of the elongated flange 58. The extensions 70 are advantageously provided with recesses 72 facing towards the spout which may be used to lift the container and easily pour the content with the aid of a lifting device as will be described below. The lifting extensions 70 may further assist in gripping of the container during removal of a threaded cap 60 as described above. Additional elongated openings 74 are punched or otherwise perforated on the top face 34 of the container 10, prior to folding and seaming of the associated sheet 12*a*, to accept the lifting extensions 70. The flange 58 is facially welded to the top face 34 of the container 10, with a peripheral seam 53 surrounding the spout opening 54 and the elongated openings 74.

Figure 9:
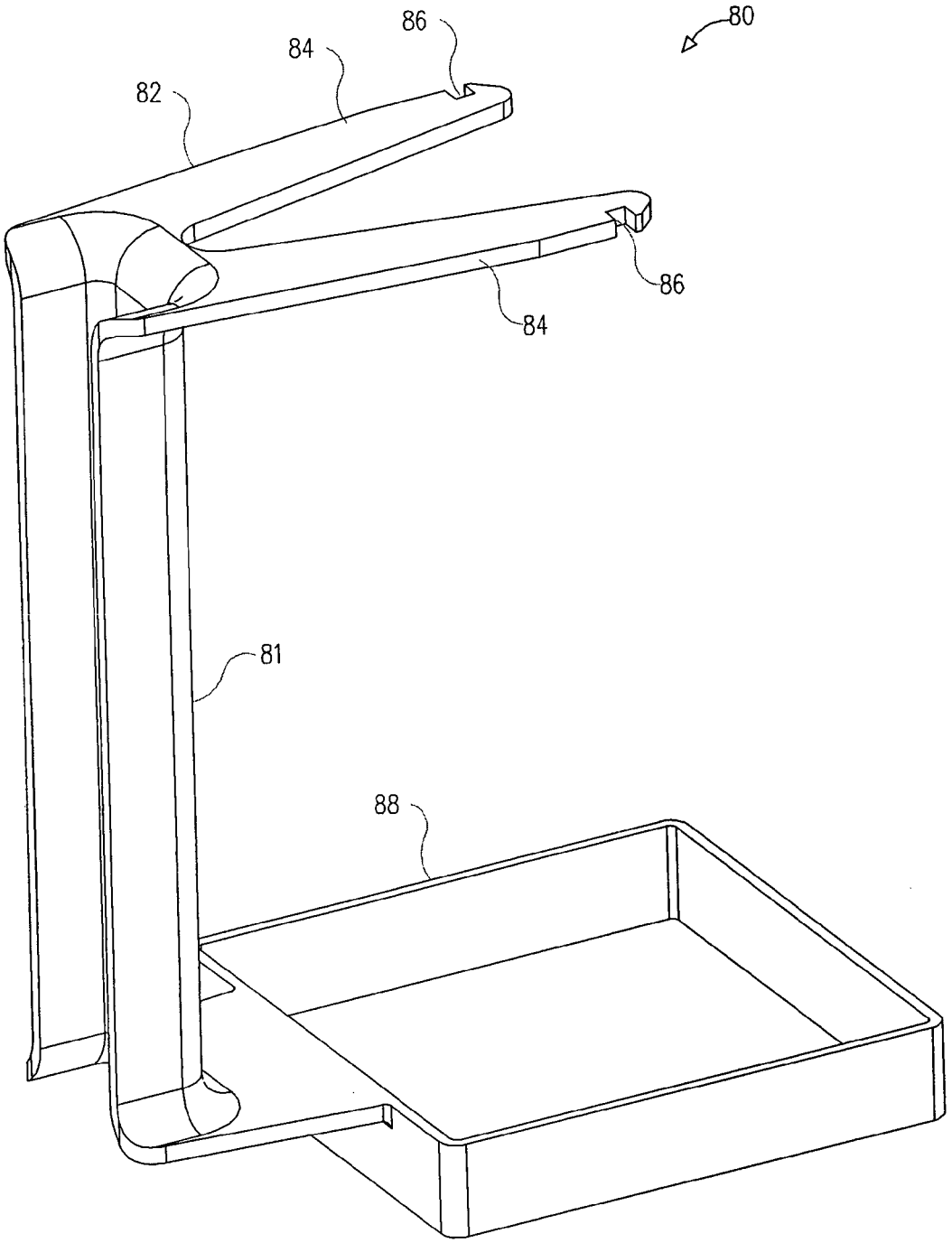
FIG. 9 is a perspective view of a lifting device applicable in conjunction with the container of FIG. 8.
Figure 10:
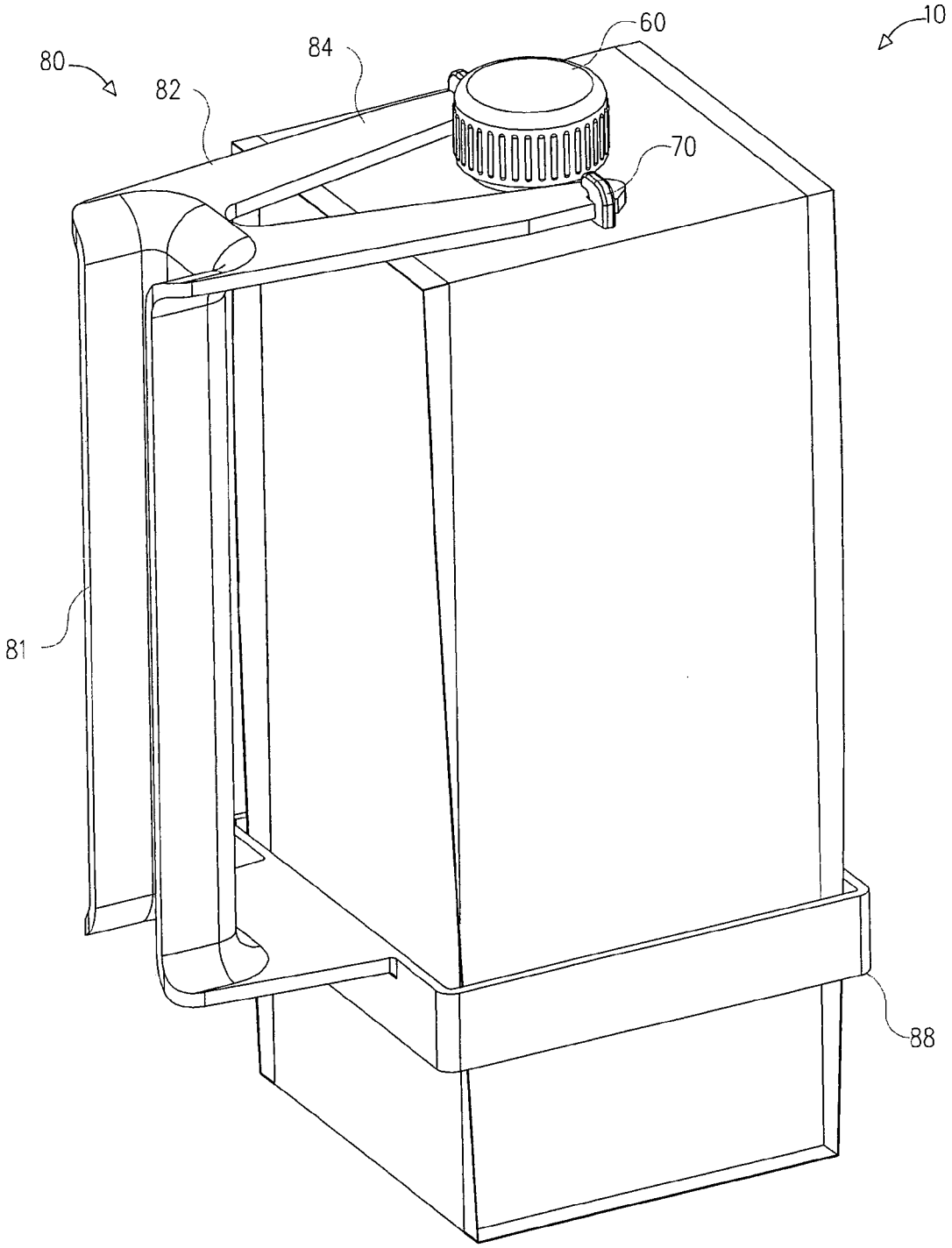
FIG. 10 is a perspective view of joined container and lifting device.

With reference to FIGS. 9 and 10, there is shown a reusable lifting device 80 composed of a handle 81 provided at its upper end with an elastic fork 82 projecting at right angle to the handle 81, and a rectangular or square frame 88 slightly larger in size than the cross section of the container 10, extending at right angle at the bottom end of the handle 81 below the fork 82. The fork 82 is formed of two spaced apart arms 84 having outwardly facing recesses 86 at their distal ends.

The lifting device 80 is placed over a standing container 10 such that the frame 86 surrounds the container, the handle 81 is further lowered and the fork arms 82 are squeezed to engage the recesses 84 of the arms 82 with the recesses 72 of the spout flange extensions 70. The joined container 10 and lifting device 80 as shown in FIG. 10 may be lifted and the content poured as with an ordinary handed bottle. The lifting device 80 is preferably not disposable as the container; it can be removed from an empty container and repeatedly used on other containers. It will be understood that the lifting device may fetch the spout 56 itself or any other stiff part of the container for the purpose of lifting, instead of using the extensions 70.

Figure 11:
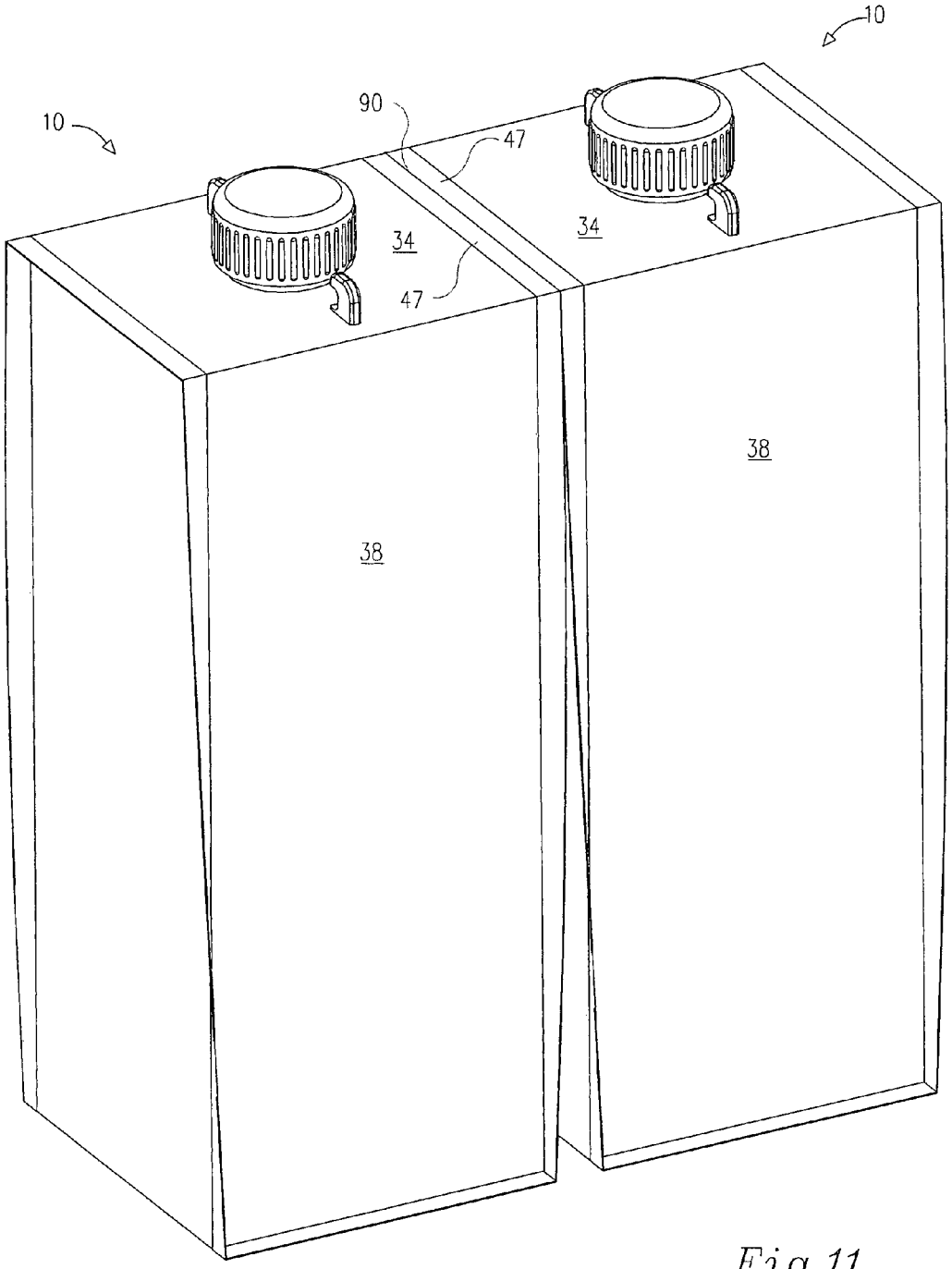
FIG. 11 is a perspective view of two containers attached side by side.

With reference to FIG. 11 there are shown two containers 10 attached to each other by sharing a common top face 34. A tear-able separation line 90 is extending between the top seam bands 47 of both containers 10. Such arrangement is provided for easier shipping and handling of plurality of containers that are sold as a unit. The separation line 90 may be alternately perforated or otherwise pressed by a sharp edge so as to reduce its strength and define a tear-able path for easy separation by the user without requiring special tools. Alternatively if the embodiment depicted in FIG. 5 is preferred, the two containers 10 may be attached to each other by sharing a common top face 34 and sidewalls 36, 38. It will be understood that any number of containers can be attached side by side in the same manner for ease of transportation and marketing.

Figure 7B:
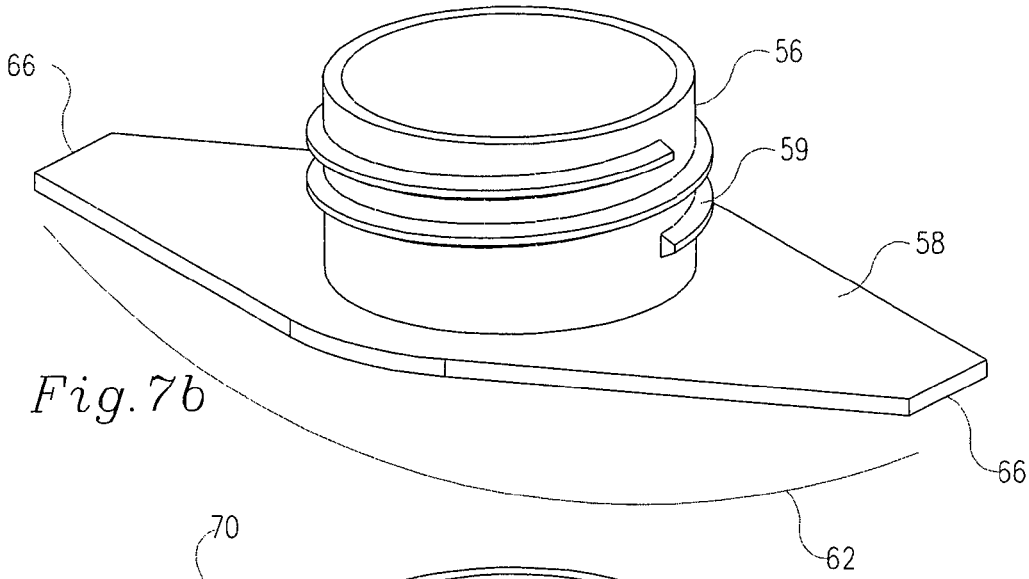
Figure 7C:
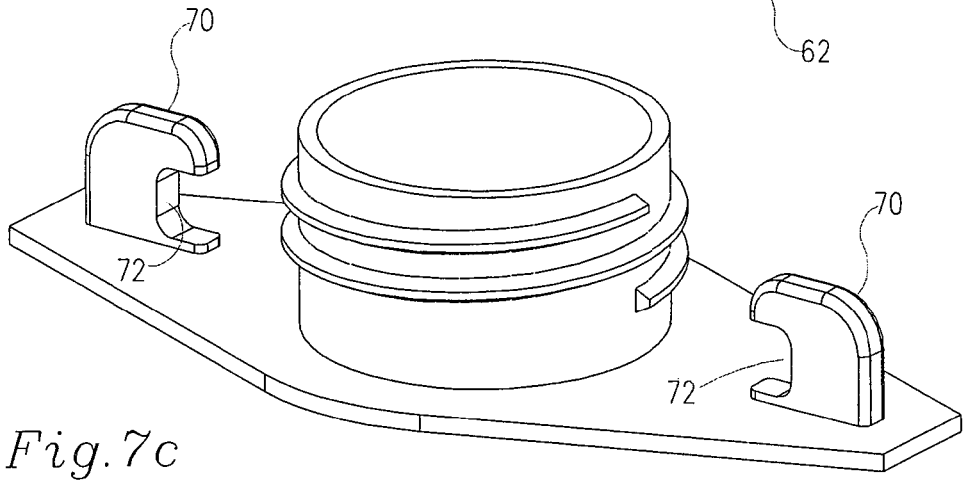
Figure 12:
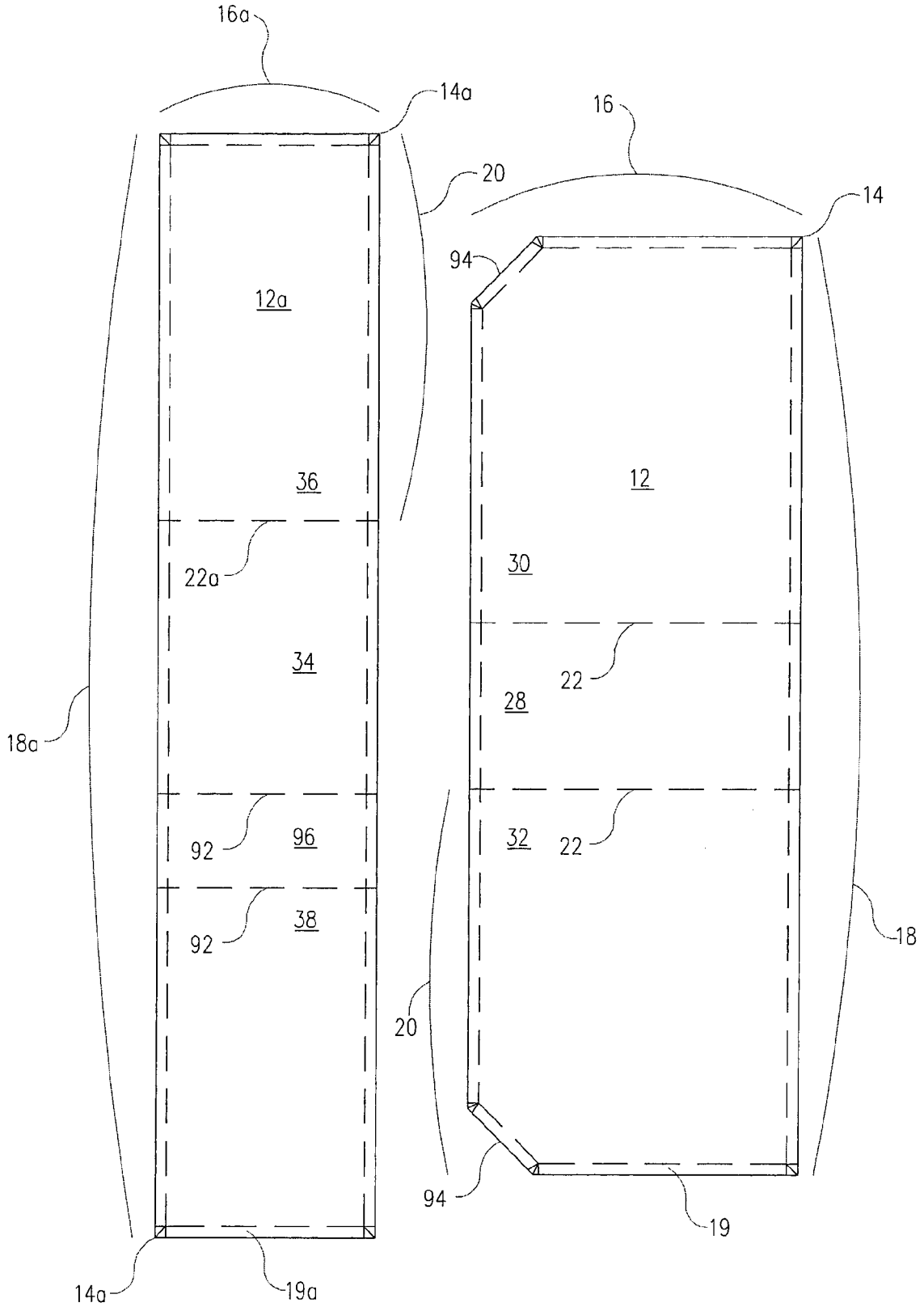
FIG. 12 is a planar view of two sheets of raw material used in production of one container according to an additional embodiment of the present invention.
Figure 13:
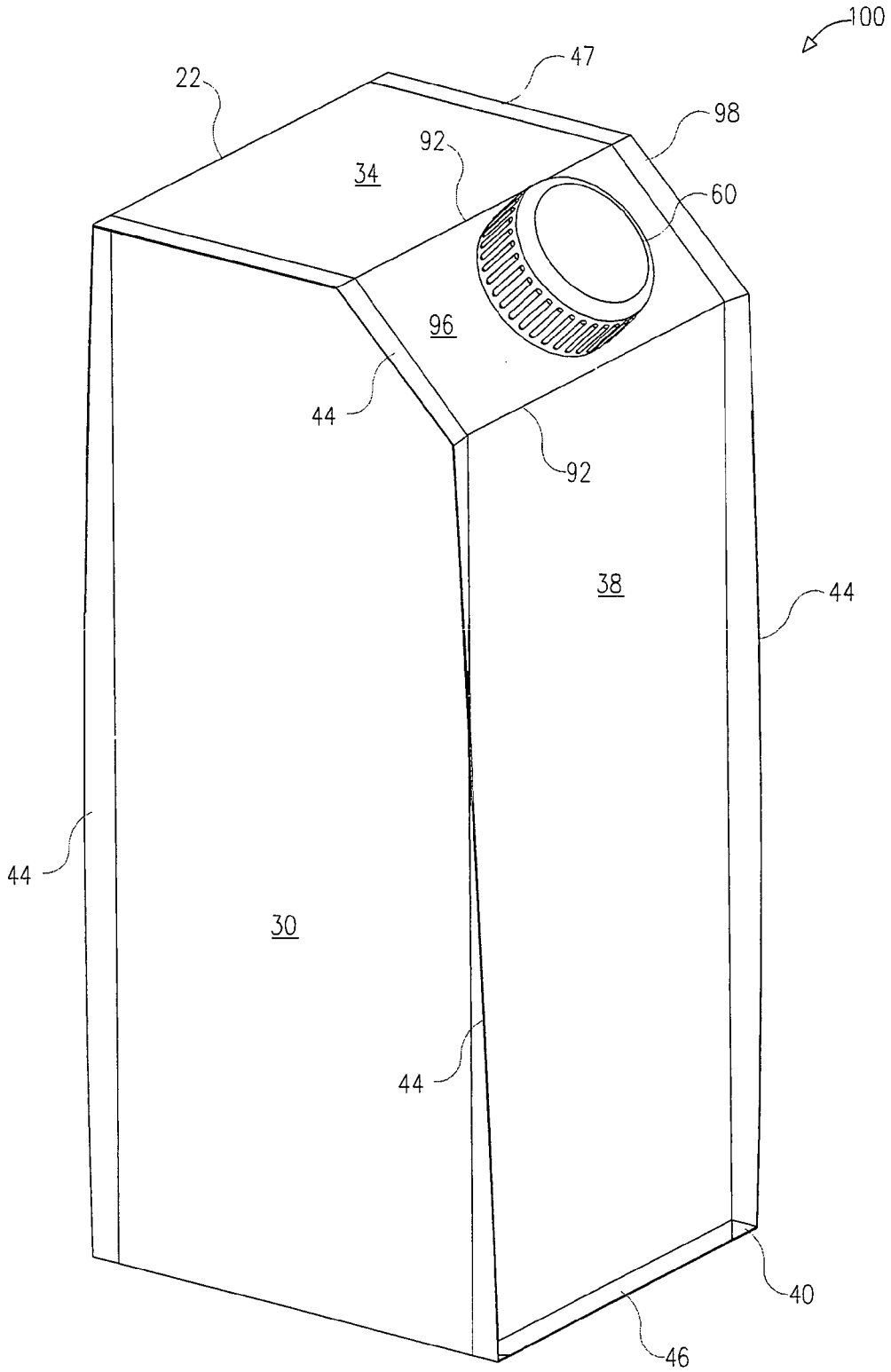
FIG. 13 is a perspective view of an assembled container made in accordance with the embodiment of FIG. 12.

Another way to facilitate pouring of the content is described in yet another embodiment of the present invention depicted in FIGS. 12 and 13. With reference to FIG. 12, which is a planar view of the two sheets of raw material used in production of one such container, at least two corners of the first sheet 12 are diagonally cut forming slanted edges 94 at the top ends of sidewalls 30, 32. Likewise, the second sheet 12*a* is folded along three transversal folding lines 92 and 22*a* to form a top face 34, a slanted face 96 obliqued at the same angle as the diagonal edges 94, and two parallel, opposing sidewalls 36, 38 of the container 100 (FIG. 13). A flanged spout, for example, such as shown in FIG. 7*b* is facially welded to the slanted face 96 of the container 100 as described above and fitted with an appropriate seal such as a threaded cap 60. It will be understood that a lifting device as described above can be used here as well with light modifications.

While the present invention has been described in conjunction with what is deemed to be the most practical and preferred embodiments of the invention, it will be evident to those skilled in the art that the invention is not limited to the details of the above described and the foregoing illustrated embodiments. The present invention may be embodied in other specific forms without departing from the spirit or essential attributes thereof. Accordingly, it is intended that the present invention embraces all such alternatives, modifications and variations as fall within the scope and determined by the broadest interpretation of the appended claims.

The invention claimed is:

1. A flexible rectangular cuboid container comprising a first and a second elongated rectangular sheets of a thin film weldable plastic or laminate material and a weldable spout, wherein the length of each of said first and second sheets is approximately equal to twice the length of a selected edge of the container plus the width of the other sheet, said first sheet is folded along two transversal lines to form a base and two equal in length opposing sidewalls of said rectangular cuboid container and said second sheet is folded along two transversal lines to form a complementary top face and two equal in length opposing sidewalls of said rectangular cuboid container, said first and second sheets are seamed to each other along a welding margin surrounding their entire periphery forming an endless loop of a fin like seam band extending along 8 of the 12 cuboid edges, wherein the sections of said fin like seam band binding said four sidewalls are shaped in the form of a 90° helix, the formed helical contour flows naturally from the bottom seam band sections being planar with said base, towards the top seam band sections being planar with said top face, thus avoiding undesired stretch of said plastic or laminate material.

2. The container as claimed in claim 1, wherein said welding margin surrounding said first and second rectangular sheets is gradually outwardly folded along the free boundaries of said sidewalls to form a narrow welding strip as a preparation step prior to seaming said first and second rectangular sheets to each other along said welding strip.

3. The container as claimed in claim 2, wherein a square portion of said welding strip located at all four corners of each of said first and second sheets is folded during said preparation step as a three layer overlapping triangular.

4. The container as claimed in claim 1, wherein said top face of the container is perforated with at least one opening prior to folding and seaming of the associated second sheet, with a hole sized to accept said spout, said spout is provided with a planar flange, which is facially welded to said top face of the container by a peripheral seam surrounding said at least one opening.

5. The container as claimed in claim 4, wherein said flange is welded to said top face from beneath the top face.

6. The container as claimed in claim 4, wherein said flange is welded to said top face from above the top face.

7. The container as claimed in claim 4, wherein said spout is provided with an external thread to accommodate an internally threaded cap.

8. The container as claimed in claim 4, wherein said spout is sealed using a technique selected from the list of: threaded cap, heat welded thin film lead having a pulling tab, elastic snap-on cap, plastic tear-off lid and a combinations of two or more of the listed techniques.

9. The container as claimed in claim 4, wherein said planar flange is elongated in shape and said flange longer axis is sized to fit the width of the container, the distal flange edges provide rigid substance for gripping of the container.

10. The container as claimed in claim 9, wherein said elongated flange is provided with upwardly protruding lifting extensions adjacent both edges of the elongated flange said extensions are provided with recesses facing towards the spout.

11. The container as claimed in claim 10, wherein two openings, elongated in shape are perforated on the top face of said container prior to folding said first sheet and seaming of the second sheet, to accept said lifting extensions, said flange is facially welded to said top face of the container with a peripheral seam surrounding the spout opening and said elongated openings.

12. The container as claimed in claim 1, further comprising a reusable lifting device composed of a handle provided at its upper end with an elastic fork projecting at right angle to the handle and a rectangular frame slightly larger in size than the cross section of the container extending at right angle at the bottom end of the handle below said fork.

13. The container as claimed in claim 12, wherein said fork is formed of two spaced apart arms having outwardly facing recesses at their distal ends.

14. The container as claimed in claim 13, wherein said lifting device is placed over said container while said fork arms are squeezed to enable engagement of the recesses of said arms with the recesses of the spout flange extensions for the purpose of lifting the container.

15. The container as claimed in claim 12, wherein said fork is formed of two spaced apart arms which are slightly spread to directly clamp said spout for the purpose of lifting the container.

16. The container as claimed in claim 12, wherein said fork is formed of two spaced apart arms which are slightly spread to clamp any stiff portion of the container for the purpose of lifting the container.

17. The container as claimed in claim 1, wherein at least two containers are attached to each other by sharing a common top face, a tear-able separation line is extending between the seam bands of said top face of said at least two containers.

18. The container as claimed in claim 17, wherein said separation line is alternately perforated or pressed by a sharp edge so as to reduce its strength and define a tear-able path for easy separation by the user without requiring special tools.

19. A method of producing a flexible rectangular cuboid container comprising:

(a) providing a first and a second elongated rectangular sheets of a thin film weldable plastic or laminate material and a weldable spout provided with a planar flange, wherein the length of each of the first and second sheets is approximately equal to twice the length of a selected edge of the container plus the width of the other sheet;

(b) perforating one of the sheets of the container with at least one opening sized to accept said weldable spout;

(c) facially welding said spout to said one of the sheets of the container by a peripheral seam located around the at least one opening;

(d) folding said first sheet along two transversal lines to form a base and two sidewalls of the rectangular cuboid container;

(e) folding the second sheet along two transversal lines to form the complementary top and two sidewalls of the rectangular cuboid container;

(f) gradually outwardly folding of said welding margin surrounding the first and second rectangular sheets along the free boundaries of said sidewalls of both sheets to form a narrow welding strip;

(g) folding all four corners of each of the first and second sheets as an overlapping triangular;

(h) seaming said first and second sheets to each other along a welding margin surrounding their entire periphery forming an endless loop of fin like seam band extending along 8 of the 12 cuboid edges, wherein the sections of said fin like seam band binding said four sidewalls accept the form of a 90° helix flowing naturally from the bottom seam bands being planar with the base, towards the top seam bands being planar with said top face.

* * * * *